US005584105A

United States Patent [19]

Krauss

[11] Patent Number: 5,584,105

[45] Date of Patent: Dec. 17, 1996

[54] QUICK DISCONNECT BUCKLE

[75] Inventor: Mark J. Krauss, E. Greenwich, R.I.

[73] Assignee: American Cord & Webbing Co., Inc., Woonsocket, R.I.

[21] Appl. No.: 587,841

[22] Filed: Jan. 11, 1996

[51] Int. Cl.[6] ..... A44B 11/00

[52] U.S. Cl. ..... 24/614; 24/200; 24/615; 24/625

[58] Field of Search ..... 24/614, 615, 616, 24/625, 633, 666, 200

[56] References Cited

U.S. PATENT DOCUMENTS 4,150,464 4/1979 Tracy ..... 24/615
4,825,515 5/1989 Wolterstorff, Jr. et al. .
4,831,694 5/1989 Kong ..... 24/615
4,866,819 9/1989 Kasai .
5,084,946 2/1992 Lee .
5,131,122 7/1992 Lavato .
5,222,279 6/1993 Frano et al. ..... 24/625

*Primary Examiner*—Victor N. Sakran
*Attorney, Agent, or Firm*—Kane, Dalsimer, Sullivan, Kurucz, Levy, Eisele and Richard, LLP

[57] ABSTRACT

A quick disconnect buckle includes a female member with opposed side openings and a lateral opening and a male member with longitudinally extending arms and an intermediate bar that includes a lug that engages with the lateral opening. Camming surfaces on the arms and side openings causing the arms to cam against the bar to thereby lift the lug out of the lateral opening to free the male member from the female member.

8 Claims, 2 Drawing Sheets

QUICK DISCONNECT BUCKLE

FIELD OF THE INVENTION

The present invention relates to quick disconnect buckles for infant safety seats for use in vehicles or strollers.

BACKGROUND OF THE INVENTION

In many applications, it is desirable to employ a quick disconnect buckle that may be disengaged or released by simply pulling on the opposite ends of the engaged male and female members with a certain level of force. For example, it is preferred that infant or child safety seats for vehicles or strollers be equipped with straps or belts that extend about the shoulders and/or perhaps legs of an infant and be coupled with a releasable buckle. These buckles, however, are normally relatively small in size and are usually difficult to digitally manipulate because of its size or may be covered or hidden by the infant's clothing so as to be not readily visible. Therefore, there is an increasing need for a quick disconnect buckle in these instances and for such applications that may be unlatched or unlocked by applying a certain amount or magnitude of opposite force or pull on the ends of the male and female members of the buckle.

SUMMARY OF THE INVENTION

It is a principal object of the present invention to provide a quick disconnect buckle that is reliable and may be readily released by pulling on the opposite ends thereof.

Another object is to provide a quick disconnect buckle of the foregoing type that is adapted to couple a pair of straps or belts in spaced relationship.

Other objects and advantages will become apparent from the following detailed description which is to be taken in conjunction with the accompanying drawings.

DETAILED DESCRIPTION OF THE PREFERRED EMBODIMENTS

Figure 1:
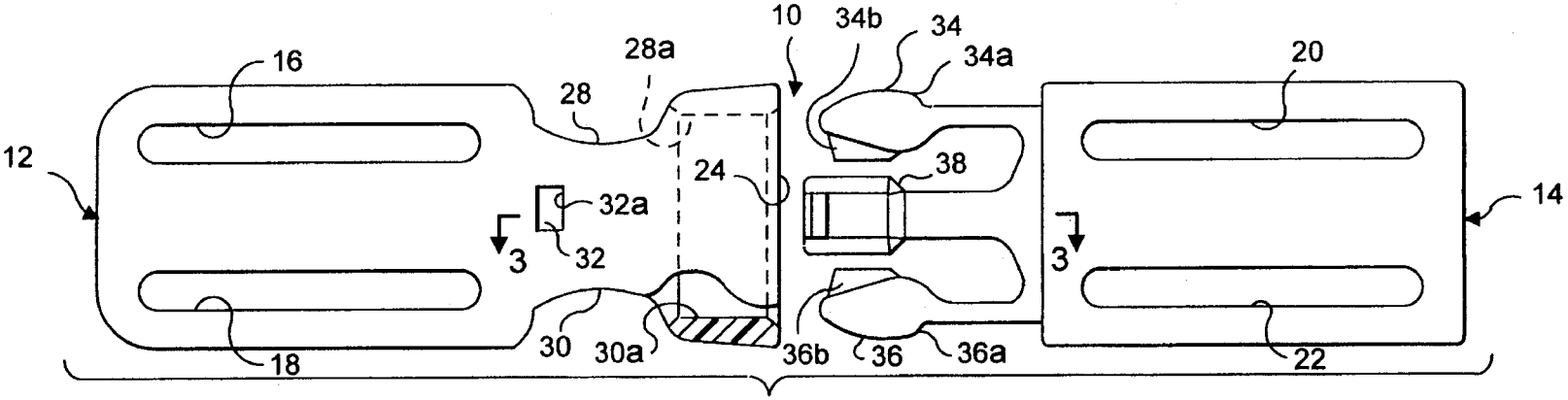
FIG. 1 is an exploded plan view of a released uncoupled female member and male member of a quick disconnect buckle of this invention.

In the drawings, a quick release or disconnect buckle 10 includes a female member 12 and a male member 14. The female member 12 is provided with longitudinal slots 16 and 18 and the male member is provided with longitudinal slots 20 and 22. These slots conveniently receive straps or belts, as for example, of the type normally contained in an infant's safety seat. The female member 12 is formed with an open end 24 having an opening 26 for receiving the male member

Figure 3:
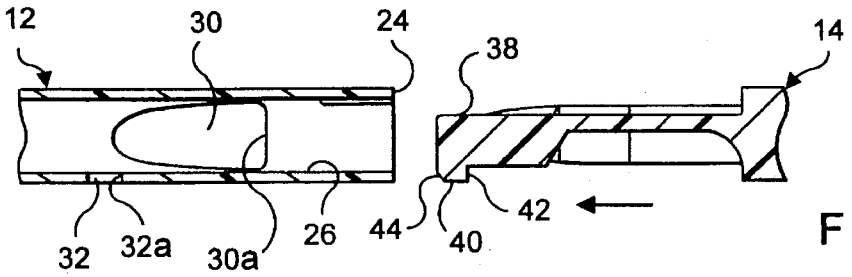
FIG. 3 is a fragmentary sectional view taken along the line 3—3 of FIG. 1.

14. In addition, female member 12 includes side openings 28 and 30 for receiving projecting camming surfaces of the male member 14 as will be described shortly. Side openings 28 and 30 define camming edges 28*a* and 30*a*. A lateral opening 32 having a latching edge 32*a* is also formed in female member 12 and is defined by surfaces that releasably latch with parts of the male member 14 as will be described. An opening 32 can be provided in both the upper and lower face of the female member 12 as shown in FIG. 3.

Referring now to the male member 14, it will be observed that a pair of spaced and projecting flexible arms 34 and 36 are provided together with a central bar 38. Arms 34 and 36 are provided with camming faces 34*a* and 36*a* that are designed to cam against respective camming edges 28*a* and 30*a* to flex inwardly arms 34 and 36, respectively. Arms 34 and 36 are also provided with camming faces 34*b* and 36*b*, respectively, that may serve to cam against surfaces of central bar 38 to flex central bar 38 upwardly as viewed in FIGS. 3 to 7. In this regard, central bar 38 is provided with camming faces $38b^1$ and $38b^2$ that cam against camming surfaces 34*b* and 36*b*, respectively, when camming surfaces 34*a* and 36*a* cam against respective edges 28*a* and 30*a* of the female member 12. This camming action raises the bar upwardly as viewed in FIGS. 3 to 7 to raise and unlatch downwardly depending lug 40 from opening 32. Lug 40 is provided with a latching shoulder 42 and a beveled camming edge 44.

Figure 2:
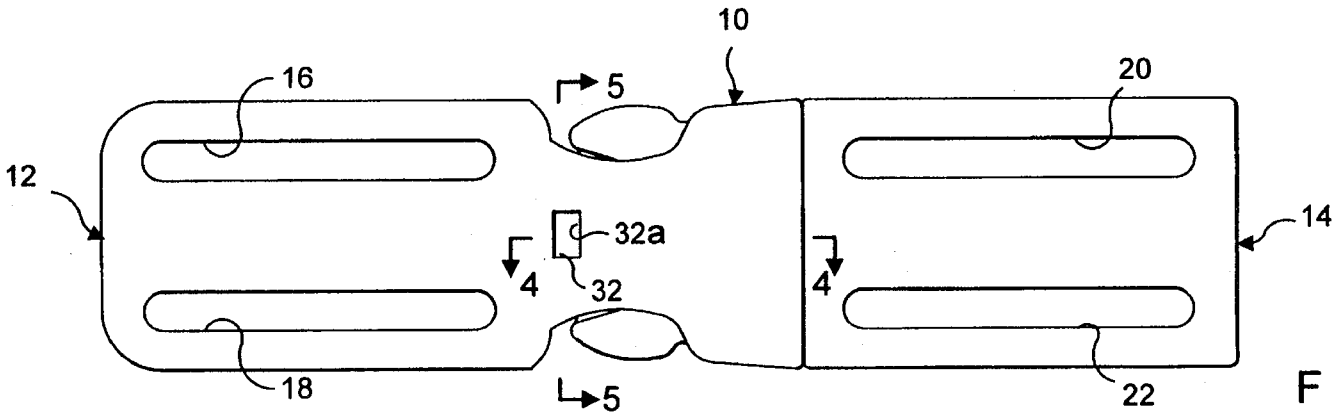
FIG. 2 is a similar plan view with the female member and male member releasably engaged and coupled.
Figure 4:
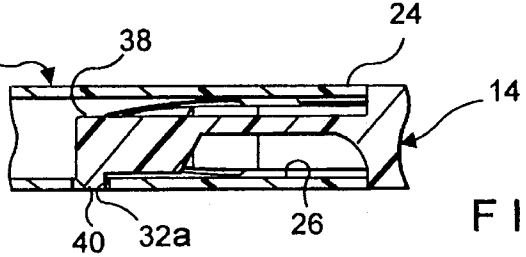
FIG. 4 is a fragmentary sectional view taken along the line 4—4 of FIG. 2.
Figure 5:
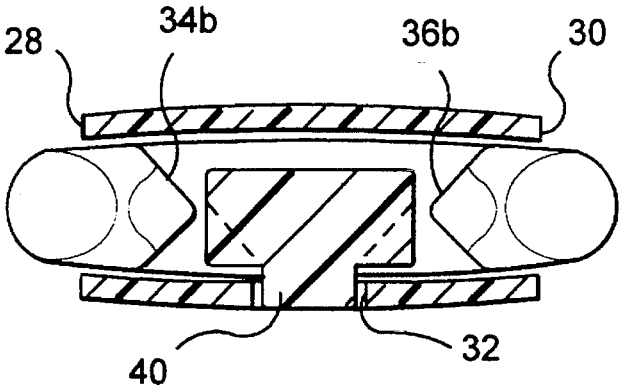
FIG. 5 is a cross sectional view taken along the line 5—5 of FIG. 2.

In order to latch buckle 10 and the otherwise unlatched female member 12 and male member 14, the opposed ends of these members are grasped and the members are moved toward one another. The arms 34 and 36 together with bar 38 of the male member 14 are forced into opening 26 of the open end 24 of the female member 12. The camming forces 34*a* and 36*a* of the arms 34 and 36, respectively, will engage surfaces of the open end 24 to flex and move the arms inwardly toward one another as viewed in FIGS. 1 and 2. Camming edge 44 will engage the open end to flex and move the bar 38 upwardly as viewed in FIGS. 3–7. As the female member 12 and male member 14 are forced together, the arms 34 and 36 and bar 38 will ride in opening 26 until camming faces clear the side openings 28 and 30 at which time the arms 34 and 36 will spring or flex outwardly as shown in FIGS. 2 and 5. When this occurs, the lug 40 will be opposite lateral openings 32 and bar 38 will spring or flex downwardly as viewed in FIG. 2 with lug 40 disposed in opening 32 and with latching shoulder 42 adapted to engage or abut against latching edge 32*a* of the opening 32 to releasably latch the female member 12 and male member 14 together.

Figure 6:
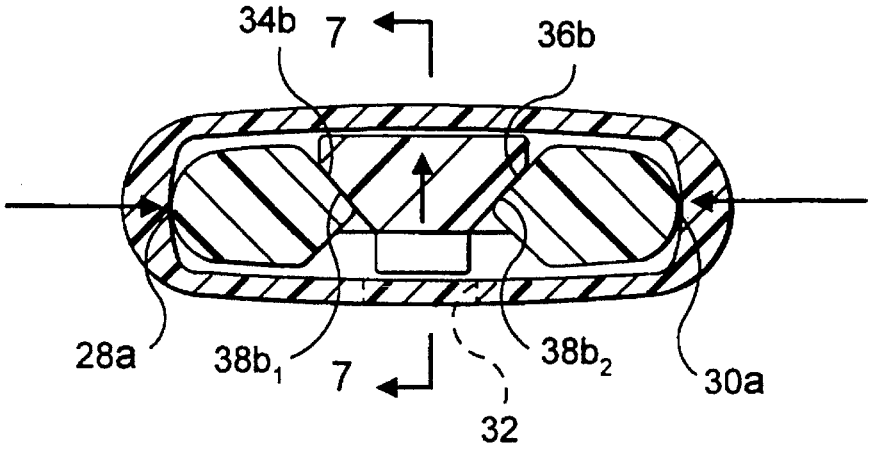
FIG. 6 is a cross sectional view taken along the line 6—6 of FIG. 2 showing the initiation of the release of the buckle.
Figure 7:
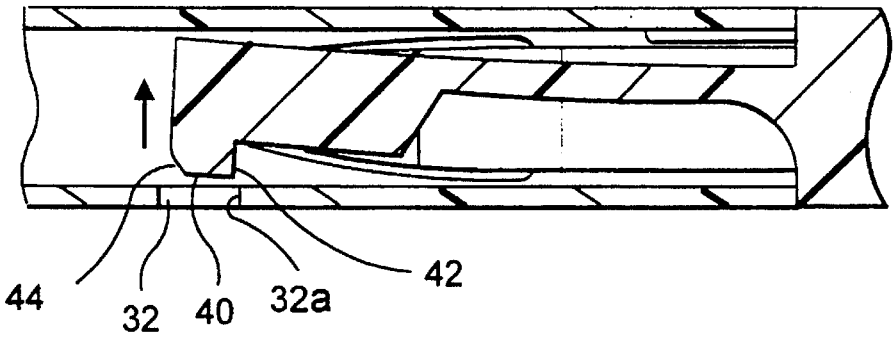
FIG. 7 is a fragmentary sectional view taken along the line 7—7 of FIG. 6.

When it is desired to unlatch the buckle 10 the opposed ends of the female member 12 and male member 14 or even the straps or belts coupled therewith are grasped and pulled apart. This action initially forces camming faces 34*a* and 36*a* of the male member 14 to cam against camming edges 28*a* and 30*a* of the female member 12. As this occurs, the arms 34 and 36 will flex and move inwardly towards one another. Camming faces 34*b* and 36*b* will engage camming faces $38b^1$ and $38b^2$. This camming action flexes and raises the bar 38 upwardly to lift the lug 40 out of the hole 32 as shown in FIGS. 6 and 7 to disengage shoulder 42 and latching edge 32*a*. The female member 12 and male member 14 can then be unlatched and completely separated. In this fashion, a quick release or disconnect buckle is provided.

Thus, the several aforenoted objects and advantages are most effectively attained. Although a single somewhat preferred embodiment has been disclosed and described in detail herein, it should be understood that this invention is in no sense limited thereby and its scope is to be determined by that of the appended claims.

I claim:

1. A quick disconnect buckle comprising:

a female member having an open end and an opposite web connecting end, said female member including opposed side walls and a top and bottom wall, a side opening in the side walls having a camming edge, a lateral opening in at least one of the top and bottom walls having a latching edge;

a male member adapted to be inserted into the female member and having a pair of longitudinally extending arms and a longitudinal bar at one end and an opposite web connecting end, each arm having a first camming face for camming against one of the camming edges of the side openings and for engaging and camming against the open end of the female member, each arm having a second camming face, the bar having a lug having a camming edge for engaging and camming against the open end of the female member and a latching shoulder for latching with the latching edge of the lateral opening, the bar having camming faces for engaging and camming against the second camming faces of the arms;

whereby upon insertion of the male member into the female member the first camming faces of the arms and the camming edge of the bar engage the open end of the female member, to flex and move the arms towards one another and flex and move the bar so that the arms and bar travel within the female member until the first camming faces of the arms are within the side opening for permitting the arms to flex outwardly and the lug is opposite the lateral opening to permit the bar to flex and move outwardly to engage the latching shoulder and latching edge of the lateral opening to releasably latch the male member into the female member, and in order to unlatch the female member and male member, these members are pulled apart at which time the first camming faces of the arms of the male member engage the camming edges of the side openings of the female member to flex the arms inwardly and cause the engagement of the second camming faces of the arms of the male member with the camming faces of the bar to flex the bar inwardly to unlatch the latching shoulder of the lug and the latching edge of the lateral opening to permit the male member to be removed from the female member.

2. The quick disconnect buckle of claim 1 wherein the male member and female member are molded of plastic.

3. The quick disconnect buckle of claim 1 wherein the web connecting end of the male member and female member includes a pair of spaced slots for receiving a strap or belt.

4. The quick disconnect buckle of claim 1 wherein the first camming faces of the arms are outwardly curved.

5. The quick disconnect buckle of claim 1 wherein the second camming faces of the arms are beveled and extend upwardly and outwardly.

6. The quick disconnect buckle of claim 1 wherein the camming faces of the bar are beveled and extend upwardly and outwardly.

7. The quick disconnect buckle of claim 1 wherein the latching shoulder of the lug and the latching edge of the lateral opening are substantially normal to the side walls of the female member.

8. The quick disconnect buckle of claim 1 wherein the male member and female member are molded of plastic;

the web connecting end of the male member and female member includes a pair of spaced slots for receiving a strap or belt;

the first camming faces of the arms are outwardly curved;

the second camming faces of the arms are beveled and extend upwardly and outwardly;

the camming faces of the bar are beveled and extend upwardly and outwardly;

the latching shoulder of the lug and the latching edge of the lateral opening are substantially normal to the side walls of the female member.

* * * * *